US006106334A

United States Patent [19]

Kuo

[11] Patent Number: 6,106,334

[45] Date of Patent: Aug. 22, 2000

[54] SHIELDED CABLE CONNECTOR

[75] Inventor: Peter Kuo, Taipei, Taiwan

[73] Assignee: Hon Hai Precision Ind. Co., Ltd., Taipei Hsien, Taiwan

[21] Appl. No.: 09/357,673

[22] Filed: Jul. 20, 1999

[30] Foreign Application Priority Data

Dec. 28, 1998 [TW] Taiwan ..... 87221655

[51] Int. Cl.[7] ..... H01R 9/03

[52] U.S. Cl. ..... 439/610; 439/98; 439/181

[58] Field of Search ..... 439/610, 98, 96, 439/108, 181, 362

[56] References Cited

U.S. PATENT DOCUMENTS 5,195,909 3/1993 Huss, Jr. et al. ..... 439/610
5,340,329 8/1994 Hirai ..... 439/610
5,735,700 4/1998 Hohorst ..... 439/98
5,788,528 8/1998 Orr, Jr. et al. ..... 439/96
5,820,412 10/1998 Koegel et al. ..... 439/610

*Primary Examiner*—Gary F. Paumen
*Attorney, Agent, or Firm*—Wei Te Chung

[57] ABSTRACT

A cable connector comprises a dielectric housing receiving a number of contacts therein, a dielectric jacket enclosing the housing and terminating a cable, and a grounding system also terminating the cable. The grounding system comprises a pair of retention members for fixing the cable connector to a mating connector, a pair of grounding members engaging with the corresponding retention members, and a pair of grounding wires terminated at the corresponding grounding members thereby forming a grounding path. The retention members extend from opposite sides of the dielectric housing proximate the contacts and are used for contacting a conductive component of the mating connector before the cable connector is mated with the mating connector.

9 Claims, 5 Drawing Sheets

SHIELDED CABLE CONNECTOR

BACKGROUND OF THE INVENTION

The present invention relates to a shielded cable connector, and particularly to a shielded cable connector having a metallic member for providing grounding effects.

The speed of electrical communication between electronic systems has increased with the rapid development of electronic network technology. Therefore, stricter requirements for resisting electromagnetic interference are placed upon cable connectors for connecting these electronic systems. Moreover, the cable connectors are apt to accumulate large quantities of static electricity thereon, which may adversely affect signal transmission between the cable connectors if the static electricity cannot be suitably discharged to ground before the connectors are electrically mated with each other.

A related conventional cable connector is commonly equipped with a metallic shield to envelop a dielectric housing thereby protecting the cable connector from electromagnetic interference. The cable connector also comprises a grounding system for discharging static electricity accumulated on the cable connector. The grounding system commonly comprises a grounding plate or grounding terminals disposed in the cable connector. The grounding plate or grounding terminals usually form a grounding path via electrical connections with the metallic shield; thus, when a mating connector is mated with the cable connector, the shield contacts with a shell of the mating connector which usually also comprises a grounding plate or grounding terminals thereby discharging the static electricity through the grounding circuit formed between the cable connector and the mating connector. However, static electricity accumulated on a cable connector and a mating connector may give out sparkles between any existed tines formed on the cable connector and the mating connector when the cable connector approaches the mating connector thereby adversely affecting signal transmission therethrough.

A pertinent conventional cable connector is disclosed in U.S. Pat. No. 5,785,555. The conventional cable connector comprises a dielectric housing receiving a plurality of data transmission terminals, a conductive shield and a two-piece rear shell substantially surrounding the housing, and a two-part terminating member including a terminal part and a cable receiving part. The two-part terminating member, a grounding plate and several coaxial cables comprise a terminal module which can be fixed to the housing and achieve grounding effects when the grounding plate contacts the shield.

However, static electricity accumulated on such a conventional cable connector may give out sparkles before the cable connector is mated with a mating connector. Moreover, the terminal module consisting of the two-part terminating member, the grounding plate and several coaxial cables has a complicated structure thereby increasing manufacturing costs and hindering quick assembly.

BRIEF SUMMARY OF THE INVENTION

A main object of the present invention is to provide a shielded cable connector having a grounding path for promoting excellent signal transmission.

Another object of the present invention is to provide a shielded cable connector which can be easily manufactured thereby decreasing manufacturing costs and simplifying assembly.

A shielded cable connector in accordance with one aspect of the present invention comprises a dielectric jacket enclosing the cable connector, a dielectric housing receiving a plurality of contacts, a cable terminated at the contacts, and a grounding system.

The grounding system comprises two grounding wires of the cable, a pair of retention members and a pair of metallic grounding members. The retention members are mounted on opposite sides of the dielectric jacket for retaining the cable connector with a mating connector. Each retention member comprises a screw end covered by screw-thread for mating with a screw hole of the mating connector, a handle and a middle portion formed between the screw end and the handle.

The metallic grounding members are properly mounted to an expanded portion of the middle portion of the corresponding retention members. The retention members and the grounding wires of the cable are terminated at the cable connector. Each grounding member is stamped and formed from a metal sheet, and comprises a retention portion and a terminating portion. The retention portion of each grounding member defines a receiving opening for engaging with a retention member. The terminating portion defines a terminating hole for terminating with a grounding wire of the cable terminated at the cable connector. Thus, a grounding path is established by the retention screws, the grounding members and the grounding wires.

When the cable connector approaches the mating connector, the retention members will first contact a conductive component of the mating connector. The conductive component can be a metallic shell or a screw hole plated with a conductive coat or some other suitable conductive material. Therefore, the grounding system in accordance with the present invention can discharge static electricity accumulated on the cable connector and the mating connector via the grounding path before the cable connector is mated with the mating connector.

Other objects, advantages and novel features of the invention will become more apparent from the following detailed description when taken in conjunction with the accompanying drawings.

DETAILED DESCRIPTION OF THE INVENTION

Figure 1:
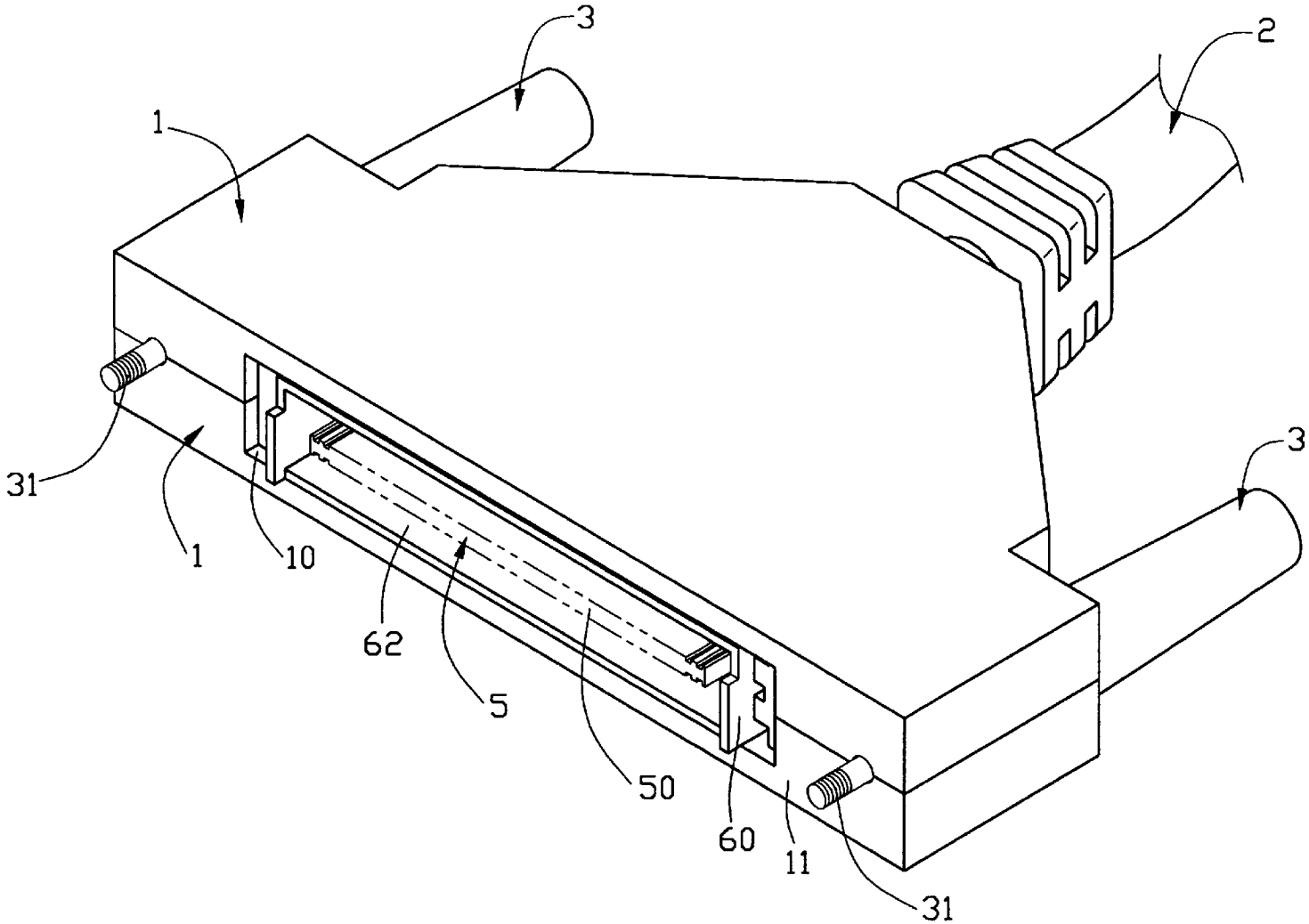
FIG. 1 is a perspective view of a cable connector in accordance with the present invention.
Figure 2:
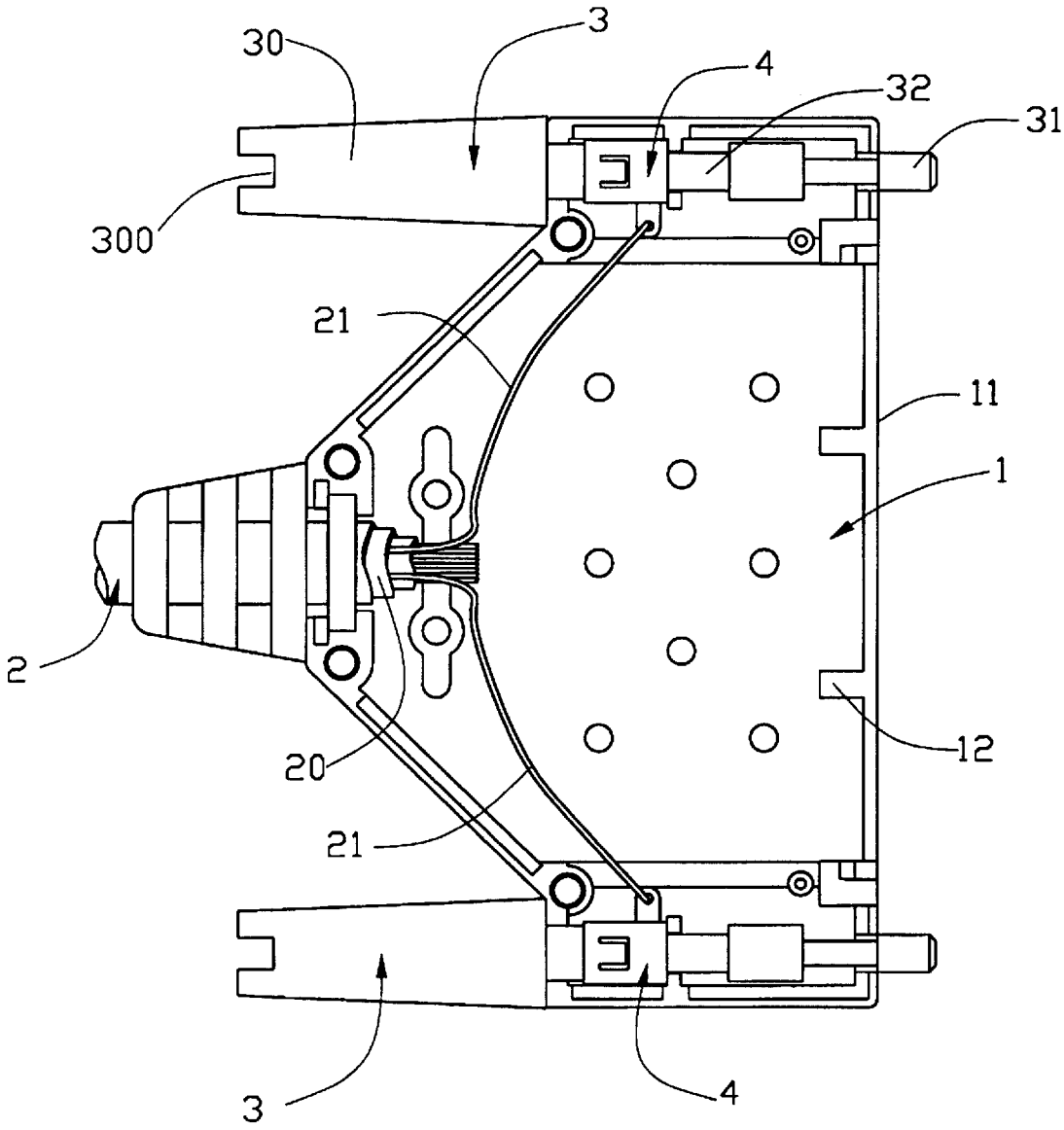
FIG. 2 is a plan view of the cable connector omitting redundant components for clearly showing a grounding system in accordance with a first embodiment of the present invention.

Referring to FIGS. 1 and 2, a cable connector in accordance with the present invention comprises a dielectric jacket 1 consisting of upper and lower components, a dielectric housing 5 receiving a plurality of contacts (not shown), a metallic shield including upper and lower shells 60 and 62, a cable 2 terminated at the contacts of the housing 5, and a grounding system for grounding the cable connector.

The jacket 1, the housing 5 and the shield are substantially identical to conventional cable connectors. The jacket 1 defines a mating opening 10 in a mating face 11 thereof for a mating portion 50 of the housing 5 to be disposed therein with the shield appropriately extending therefrom, whereby a mating connector (not shown) can be inserted into the mating opening 10 to electrical connect with the cable connector.

As shown in FIG. 2, the upper component of the jacket 1, the upper shell and the housing 5 are removed to show the grounding system. The jacket 1 forms several flanges 12 on an inner edge of the mating face 11 for properly positioning the housing 5 thereon. The cable 2 comprises an insulative covering (not labeled), a shielding braid 20, a plurality of data wires (not labeled) and two grounding wires 21. The two grounding wires 21 also can be formed by ramifying a distal end of a grounding wire of the cable 2 into two strands or by some other suitable means.

Figure 3:
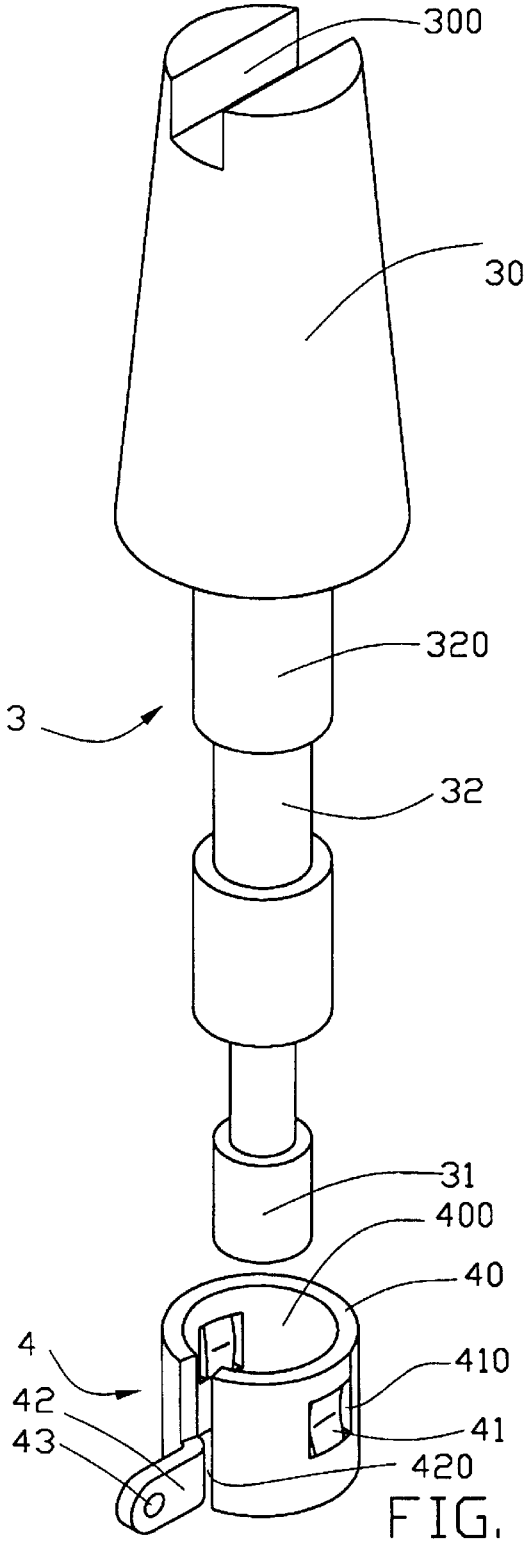
FIG. 3 is a perspective view of a grounding member and a retention screw in accordance with the first embodiment of the present invention before assembly.
Figure 4:
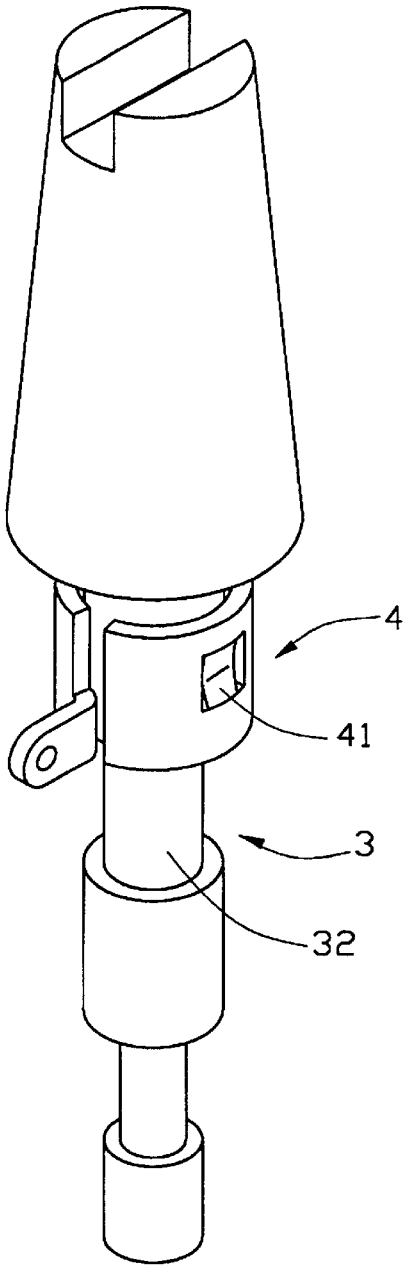
FIG. 4 is an assembled view of FIG. 3.

Also referring to FIGS. 3 and 4, the grounding system in accordance with a first embodiment of the present invention comprises the grounding wires 21, a pair of retention members 3 and a pair of metallic grounding members 4. Each retention member 3 is elongate and forms a handle 30 defining a cutout 300 for facilitating manual operation, a middle portion 32 for engaging with the corresponding grounding member 4, and a screw end 31 covered by screw-thread for engaging within a corresponding screw hole of the mating connector.

Each grounding member 4 comprises a retention portion 40 and a terminating portion 42. The retention portion 40 of each grounding member 4 is cylindrical and defines a receiving opening 400 surrounded by a circumferential side wall, several apertures 410 and a slit 420 in the circumferential side wall. A detent 41 integrally extends from the circumferential side wall into each aperture 410, and inwardly projects for properly engaging with an expanded section 320 of the middle portion 32. The terminating portion 42 of each grounding member 4 extends from a lower edge of the circumferential side wall proximate the slit 420 and defines a terminating hole 43 therein for terminating the corresponding grounding wire 21.

Figure 5:
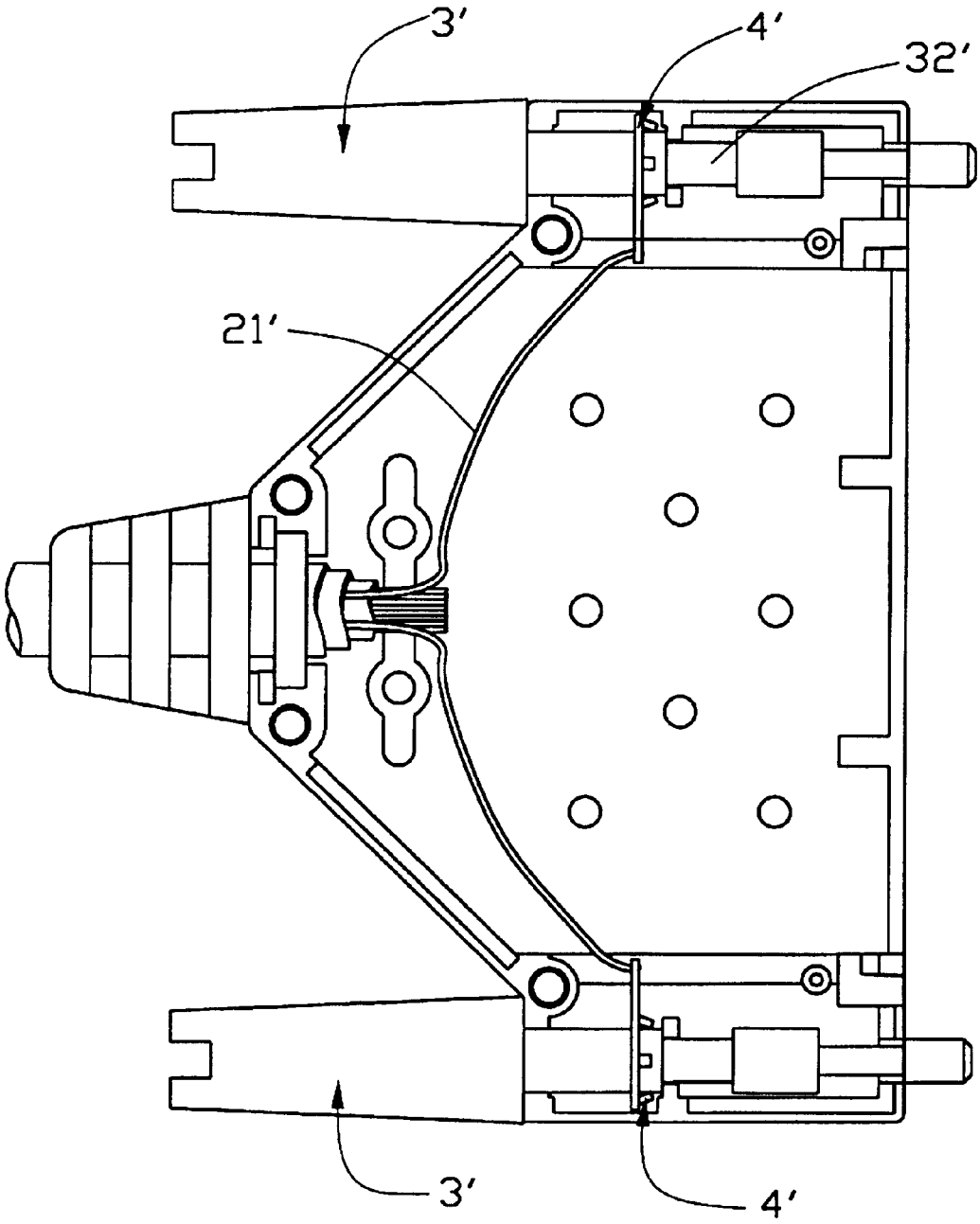
FIG. 5 is a plan view of the cable connector omitting redundant components for clearly showing a grounding system in accordance with a second embodiment of the present invention.
Figure 6:
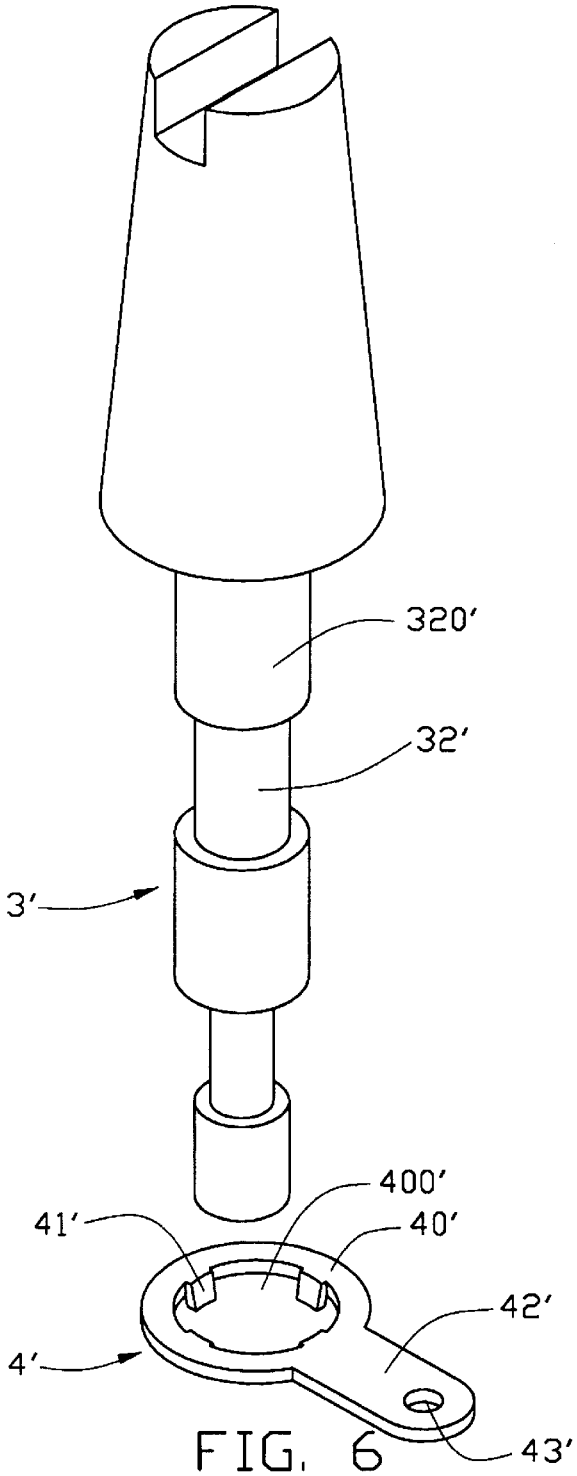
FIG. 6 is a perspective view of a grounding member and a retention screw in accordance with the second embodiment of the present invention before assembly.
Figure 7:
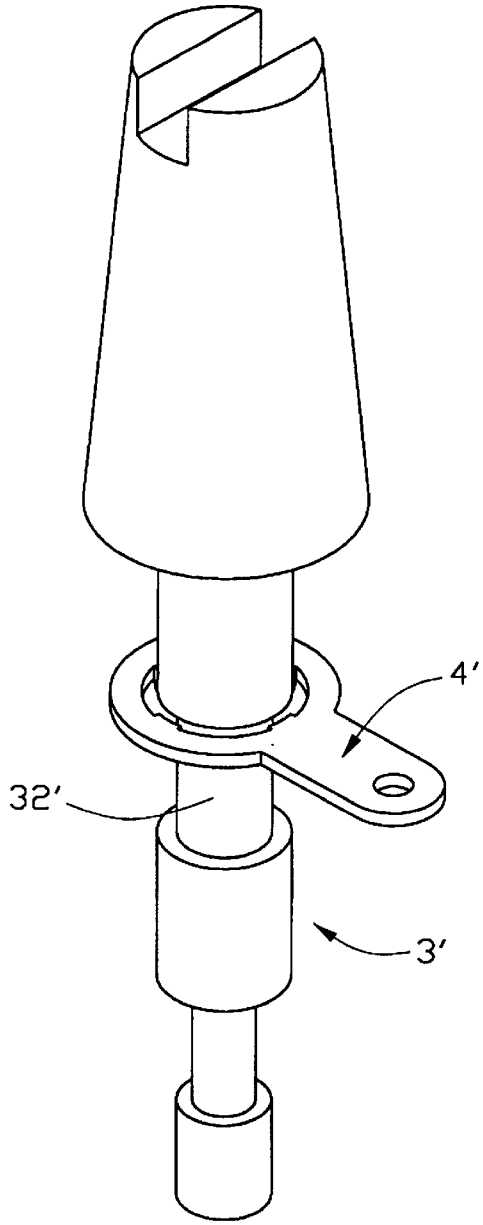
FIG. 7 is an assembled view of FIG. 6.

Referring to FIGS. 5, 6 and 7, the grounding system in accordance with a second embodiment of the present invention also comprises two grounding wires 21', a pair of retention members 3' and a pair of metallic grounding members 4'. The grounding wires 21 and the retention members 3' are substantially the same as the grounding wires 21 and the retention members 3 of the first embodiment. Other components in accordance with the second embodiment of the present invention except the grounding members 4' are substantially identical to the corresponding components of the first embodiment.

Each grounding member 4' is stamped and formed from a metal sheet, and comprises a circular retention portion 40' and a terminating portion 42'. The retention portion 40' of each grounding member 4' defines a receiving opening 400', and forms several detents 41'. The detents 41' integrally extend from a top surface of the retention portion 40' and inwardly project from a ring thereof for properly engaging with an expanded section 320' of a middle portion 32' of the corresponding retention member 3'. The terminating portion 42' of each grounding member 4' integrally extends from the retention portion 40', and defines a terminating hole 43' for terminating a corresponding grounding wire 21'.

Referring back to FIGS. 1, 2 and 5, the assembly of the present invention is substantially similar to conventional cable connectors, thus, an explanation assembly procedures is omitted herein except for the assembly process of the grounding system of the present invention.

In the first embodiment, the grounding members 4 are fixed to the corresponding retention members 3 by inserting the screw ends of the retention members 3 into the receiving openings 400 of the corresponding grounding members 4. Thus, the retention portion 40 of each grounding member 4 properly engages with the expanded section 320 of the middle portion 32 of the corresponding retention member 3. The grounding wires 21 of the cable 2 are then terminated at the terminating holes 43 of the grounding members 4 by soldering or other suitable means. Therefore, the grounding system forms a grounding path via the retention members 3, the grounding members 4 and the grounding wires 21 of the cable 2. When the cable connector approaches the mating connector, the retention members 3 will first contact a conductive component of the mating connector. The conductive component can be a metallic shell, a screw hole plated with a conductive coat or some other suitable conductive material. Therefore, the grounding system can discharge static electricity accumulated on the cable connector and the mating connector via the grounding path before the cable connector mates with the mating connector.

The assembly process of the second embodiment is substantially the same with the first embodiment, thus, a description thereof is omitted herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a dielectric housing receiving a plurality of contacts in a mating end portion thereof for electrically connecting with a mating connector;

a cable having a grounding wire;

a dielectric jacket enclosing the dielectric housing at one end thereof and connecting to the cable at an opposite end thereof;

a conductive retention member for securely fixing to the mating connector, to maintain engagement of the connector with the mating connector and a separate grounding member connected to both the conductive retention member and the grounding wire of the cable to form a grounding path;

wherein the grounding member is mounted around and supported by the conductive retention member and remains in direct electrical and mechanical contact therewith.

2. The cable connector as claimed in claim 1, wherein the retention member outwardly projects from a lateral side of the mating end portion of the dielectric housing to electrically contact a conductive outer member of the mating connector and comprises a middle portion for engaging with the grounding member.

3. The cable connector as claimed in claim 1, wherein the grounding member comprises a retention portion for engaging a middle portion of the retention member and a terminating portion for terminating the grounding wire.

4. The cable connector as claimed in claim 3, wherein the retention portion is cylindrical and defines a receiving opening surrounded by a circumferential side wall of the retention portion for engaging with the middle portion of the retention member.

5. The cable connector as claimed in claim 4, wherein a detent integrally extends from the circumferential side wall into a corresponding aperture defined in the circumferential side wall and inwardly projects for properly engaging with an expanded section of the middle portion of the retention member.

6. The cable connector as claimed in claim 4, wherein the terminating portion extends from a lower edge of the circumferential side wall proximate a slit defined in the circumferential side wall and defines a terminating hole for terminating the grounding wire.

7. The cable connector as claimed in claim 3, wherein the retention portion is circular and defines a receiving opening surrounded by a ring for engaging with the middle portion of the retention member.

8. The cable connector as claimed in claim 7, wherein the retention portion forms several detents integrally extending from a top surface of the ring and inwardly projecting therefrom for latching to an expanded section of the middle portion of the retention member.

9. The cable connector as claimed in claim 7, wherein the terminating portion integrally extends from the retention portion and defines a terminating hole for terminating the grounding wire.

* * * * *